US010082005B2

(12) United States Patent
Salomonsen et al.

(10) Patent No.: US 10,082,005 B2
(45) Date of Patent: Sep. 25, 2018

(54) METHOD AND DEVICE FOR SETTING AND RETRIEVING A CROWN PLUG

(71) Applicant: Interwell AS, Hafrsfjord (NO)

(72) Inventors: Helge Salomonsen, Hafrsfjord (NO); Trond Eidebakk B. Lunde, Hundvåg (NO); Arild F. Stein, Sandnes (NO)

(73) Assignee: Interwell AS, Hafrsfjord (NO)

( * ) Notice: Subject to any disclaimer, the term of this patent is extended or adjusted under 35 U.S.C. 154(b) by 0 days.

(21) Appl. No.: 15/555,728

(22) PCT Filed: Mar. 2, 2016

(86) PCT No.: PCT/EP2016/054388

§ 371 (c)(1),
(2) Date: Sep. 5, 2017

(87) PCT Pub. No.: WO2016/139228

PCT Pub. Date: Sep. 9, 2016

(65) Prior Publication Data

US 2018/0058181 A1 Mar. 1, 2018

(30) Foreign Application Priority Data

Mar. 2, 2015 (NO) ..... 20150277

(51) Int. Cl.
*E21B 41/04* (2006.01)
*E21B 33/076* (2006.01)
*E21B 33/038* (2006.01)

(52) U.S. Cl.
CPC ..... *E21B 41/04* (2013.01); *E21B 33/038* (2013.01); *E21B 33/076* (2013.01)

(58) Field of Classification Search
CPC ..... E21B 33/038; E21B 33/076; E21B 41/04
(Continued)

(56) References Cited

U.S. PATENT DOCUMENTS 2,798,559 A 7/1957 Fredd
5,875,851 A 3/1999 Vick, Jr. et al.
(Continued)

FOREIGN PATENT DOCUMENTS

EP 2469014 A1 6/2012

OTHER PUBLICATIONS

International Search Report issued in application No. PCT/EP2016/054388 dated May 19, 2016 (2 pages).
(Continued)

*Primary Examiner* — James G Sayre
(74) *Attorney, Agent, or Firm* — Osha Liang LLP

(57) ABSTRACT

A device for setting and retrieving a crown plug in a well head. The device has a mandrel device, an outer housing device, a snap sleeve device downwardly protruding from the lower end of the mandrel device and a locking element. The device has an upper plug connection device and a lower plug connection device for connection to the upper connection interface and a lower plug connection device of the crown plug, respectively. An annular compartment is provided radially outside at least parts of the locking element and radially inside a lower end section of the mandrel device. An upper end of the snap sleeve device is provided axially displaceable in the annular compartment. The lower plug connection device may be configured between a locked state and an unlocked state by axial displacement of the snap sleeve device in relation to the locking element.

20 Claims, 8 Drawing Sheets

(58) Field of Classification Search
USPC ..... 166/339, 365, 368, 351, 125, 187, 89.3, 166/297, 386, 106, 179, 135
See application file for complete search history.

(56) References Cited

U.S. PATENT DOCUMENTS

| | | | | |
|---|---|---|---|---|
| 7,677,319 | B2 * | 3/2010 | Baskett | E21B 33/035 166/360 |
| 8,869,899 | B2 * | 10/2014 | Caulfield | E21B 33/043 166/179 |
| 2003/0146000 | A1 | 8/2003 | Dezen et al. | |
| 2004/0163818 | A1 * | 8/2004 | Fenton | E21B 19/002 166/368 |
| 2009/0025939 | A1 * | 1/2009 | Wenham | E21B 33/035 166/368 |
| 2009/0236100 | A1 * | 9/2009 | Lawson | E21B 33/043 166/339 |
| 2010/0170681 | A1 | 7/2010 | Purkis | |
| 2012/0037374 | A1 * | 2/2012 | Schuurman | E21B 33/064 166/340 |
| 2012/0043089 | A1 * | 2/2012 | Hoffman | E21B 33/064 166/340 |

OTHER PUBLICATIONS

Written Opinion of the International Searching Authority issued in application No. PCT/EP2016/054388 dated May 19, 2016 (6 pages).
Norwegian Search Report issued in application No. 20150277 dated Oct. 14, 2015 (2 pages).

* cited by examiner

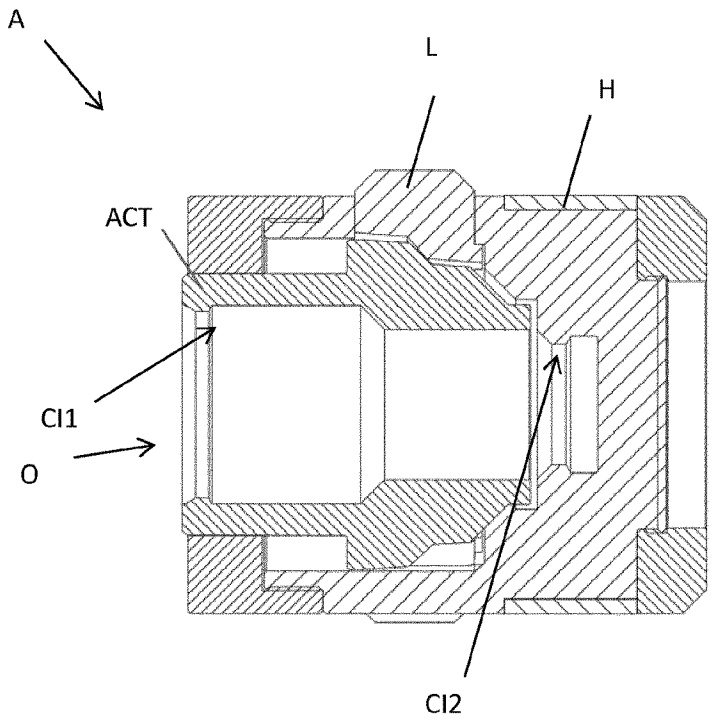
Fig. 2: Prior art
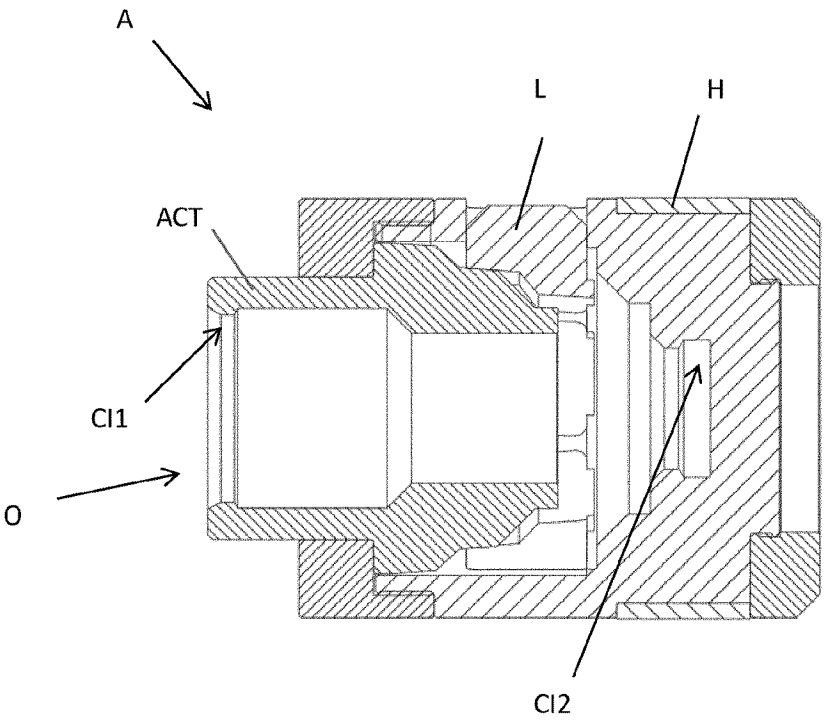
Fig. 1: Prior art

METHOD AND DEVICE FOR SETTING AND RETRIEVING A CROWN PLUG

FIELD OF THE INVENTION

The present invention relates to a device for setting a crown plug in a well head and for retrieving the crown plug from the well head and a method for setting and retrieving crown plugs used in horizontal subsea trees.

BACKGROUND OF THE INVENTION

Some subsea oil and/or gas wells have a type of horizontal Christmas tree (HXT) installed (about 500+ units on the Norwegian continental shelf). Such HXTs were intentionally built without valves in the vertical bore, and the tubing with hanger was lowered through the pre-installed HXT on the subsea template. The reason for this was low need for maintenance. However, the design is was not intended for regular intervention work in the expected lifetime.

Completion integrity issues, production decrease and subsea well slot shortage demanded re-use of slots with new completion much earlier than anticipated. This, together with better drilling and completion technology made it economical viable to continue to develop a subsea field more like a conventional platform dry X-tree field.

To do this type of completion workover operations there is a need to transfer the well from production mode into drilling mode (i.e. to kill the well) in a safe manner. There has been a development in equipment and methods to do this in a most suitable way.

With RLWI (Riserless Light Well Intervention) operations are performed by means of a smaller dynamic positioned vessel and a purpose build subsea well control stack with wireline BOP. This operation needs to be done before the drilling rig arrives. It includes connection and testing of subsea stack, removing the crown plug by wireline, install a lower barrier, a punch circulation hole through the tubing wall and installation of a top barrier below the HXT. Then the RLWI stack must be rigged down and the vessel removed.

Alternatively, a rig with an additionally lower riser package (LRP) including a blowout preventer (BOP) can be used to perform this well intervention operation. The disadvantage with this type of operation is the amount of equipment needed in addition to the standard drilling BOP and LP riser. This type of prior art requires multiple re-connection operations to the subsea installation. Again a wireline crew is needed to retrieve the crown plug and install barrier plugs in the well to secure the well before disconnection of the LRP subsea stack.

In yet an alternative, a standard drilling setup with BOP and LP riser and an in-riser landing string including a top side blowout preventer (wireline BOP) may be used. A lot of extra equipment is needed in addition to the standard drilling BOP and LP riser and also here a wireline crew is needed for retrieving the crown plug.

Consequently, the disadvantages with these types of operations are that they are time consuming, relatively complicated and costly. Moreover, the weather window for performing such operations must be relatively large.

In all of the above operations, the crown plug must be removed before any type of tool can be inserted into the well. The subsea lubricator or the blowout preventer are ensuring well pressure integrity during the removal of the crown plug.

Today, a retrieval tool is used to retrieve the crown plug from the tree before the well operation, and a setting tool is used to set the crown plug in the tree after the operation again. One type of setting and retrieving tool is the Interwell GS running and pulling tool. This tool must be reconfigured between the retrieval and setting of the crown plug.

The crown plug is often referred to as an internal tree cap (ITC) plug. One example of a known crown plug the Aker ITC plug. The Aker ITC plug is illustrated in FIG. 1 in its run state and in FIG. 2 in its set state. It should be noted that FIGS. 1 and 2 are illustrations only—with main focus on the connection interface for setting and/or retrieval tool.

Consequently, the object of the invention is to provide a method for setting and retrieving crown plugs in horizontal subsea trees where costs and complexity are reduced, where well integrity is maintained or even improved and where the time window for the operation is reduced.

Moreover, the object of the invention is to provide a device for setting and retrieving crown plugs in horizontal subsea trees, where the device can run, set, retract, reset and retrieve the crown plug multiple times, without the need to bring the device and crown plug to the surface for reconfiguration.

SUMMARY OF THE INVENTION

The present invention is defined in the independent claim 1, defining a device for setting a crown plug in a well head and for retrieving the crown plug from the well head; where the crown plug comprises an upper connection interface and a lower connection interface; where the device comprises:

- a mandrel device having a upper end connected to a top sub device and a lower end;
- an outer housing device provided radially outside the mandrel device;
- a snap sleeve device downwardly protruding from the lower end of the mandrel device;
- an upper plug connection device for connection to the upper connection interface of the crown plug; where the upper plug connection device comprises first finger connectors; where the upper plug connection device may be configured between a locked state and an unlocked state by relative axial displacement between the mandrel device and the outer housing device;
- a lower plug connection device for connection to the lower connection interface of the crown plug, where the lower plug connection device comprises second finger connectors provided in a lower end of the snap sleeve device;

where

- the device comprises a locking element fixed to the lower end of the mandrel device;
- an annular compartment is provided radially outside of at least parts of the locking element and radially inside a lower end section of the mandrel device;
- an upper end of the snap sleeve device is provided axially displaceable in the annular compartment;
- the lower plug connection device may be configured between a locked state and an unlocked state by axial displacement of the snap sleeve device in relation to the locking element, wherein connection to and disconnection from the lower connection interface of the crown plug is prevented in the locked state.

In one aspect, the locking element is forming an axial extension of the mandrel device.

In one aspect, the snap sleeve device is provided radially outside of the locking element, and where radial movement of the second finger connectors is prevented by the locking element in the locked state.

In one aspect, the snap sleeve device is in its upper end position when an upper stop surface is in contact with a bottom surface of the compartment and where the snap sleeve device is in its lower end position when an inwardly protruding stop of the snap sleeve device is in contact with an outwardly protruding stop of the locking device.

In one aspect, the device further comprises a force threshold mechanism configured to provide that a first force required to displace the snap sleeve device downwardly is greater than a second force required to displace the snap sleeve device upwardly.

In one aspect, the force threshold mechanism comprises an inwardly protruding collar of the snap sleeve device and an outwardly protruding collar of the locking element configured to be engaged with each other, where the first force is required to displace the inwardly protruding collar from the lower side of the outwardly protruding collar to the upper side of the outwardly protruding collar and where the second force is required to move the inwardly protruding collar from the upper side of the outwardly protruding collar to the lower side of the outwardly protruding collar.

In one aspect, the inwardly protruding collar has an angle α53lower for the lowermost part of the collar in relation to the longitudinal axis being less than an angle α53upper for the uppermost part of the collar in relation to the longitudinal axis.

In one aspect, the angle α53lower is between 5-30°, even more preferable 8-20°, and where the angle α53upper is between 45-85°, even more preferable 60-80°.

In one aspect, the outwardly protruding collar is designed with an angle α43lower for the lowermost part of the collar 43 in relation to the longitudinal axis being approximately equal to the angle α53upper.

In one aspect, a longitudinal fluid bore is provided through the top sub device, the mandrel device, the releasable locking element and the snap sleeve device, thereby allowing fluid flow from the upper end of the device to the lower end of the device.

DETAILED DESCRIPTION

Embodiments of the invention will now be described with reference to the enclosed drawings, where:

FIGS. 1 and 2 illustrates a prior art crown plug for a horizontal tree in its run and set state respectively;

FIG. 9 illustrates the setting and retrieval device connected to the crown plug in their third state;

Initially, a crown plug A will be described with reference to FIGS. 1 and 2. The crown plug A is here an Aker ITC plug, and the present invention is adapted to this plug. However, the same principles may be applied to crown plugs from other manufacturers or other types of crown plugs.

The crown plug A comprises an outer housing H wherein an actuator ACT is provided. An access opening O is provided into the housing H through the actuator ACT. The actuator ACT comprises a first connection interface CI1 in the outermost part of the opening O and the housing H comprises a second connection interface CI2 in the innermost part of the opening O. Axial movement of the actuator ACT in relation to the housing H will bring a locking device L between its run and set states. In FIG. 1 the run state is shown. If the actuator ACT is pushed downwards (i.e. to the right in FIGS. 1 and 2) the locking device L will be pushed radially outwards to the set state in FIG. 2. If the actuator ACT is pulled upwards (i.e. to the left in FIGS. 1 and 2) the locking device will be pulled radially inwards to its run state in FIG. 1 again. The first and second connection interfaces CI1 and CI2 are used by the setting and retrieval tool(s) for movement of the plug A up and down in the well and to actuate the plug A between its run and set states.

As mentioned in the introduction, the crown plug A is considered to be prior art and will not be described further in detail herein.

Figure 3:
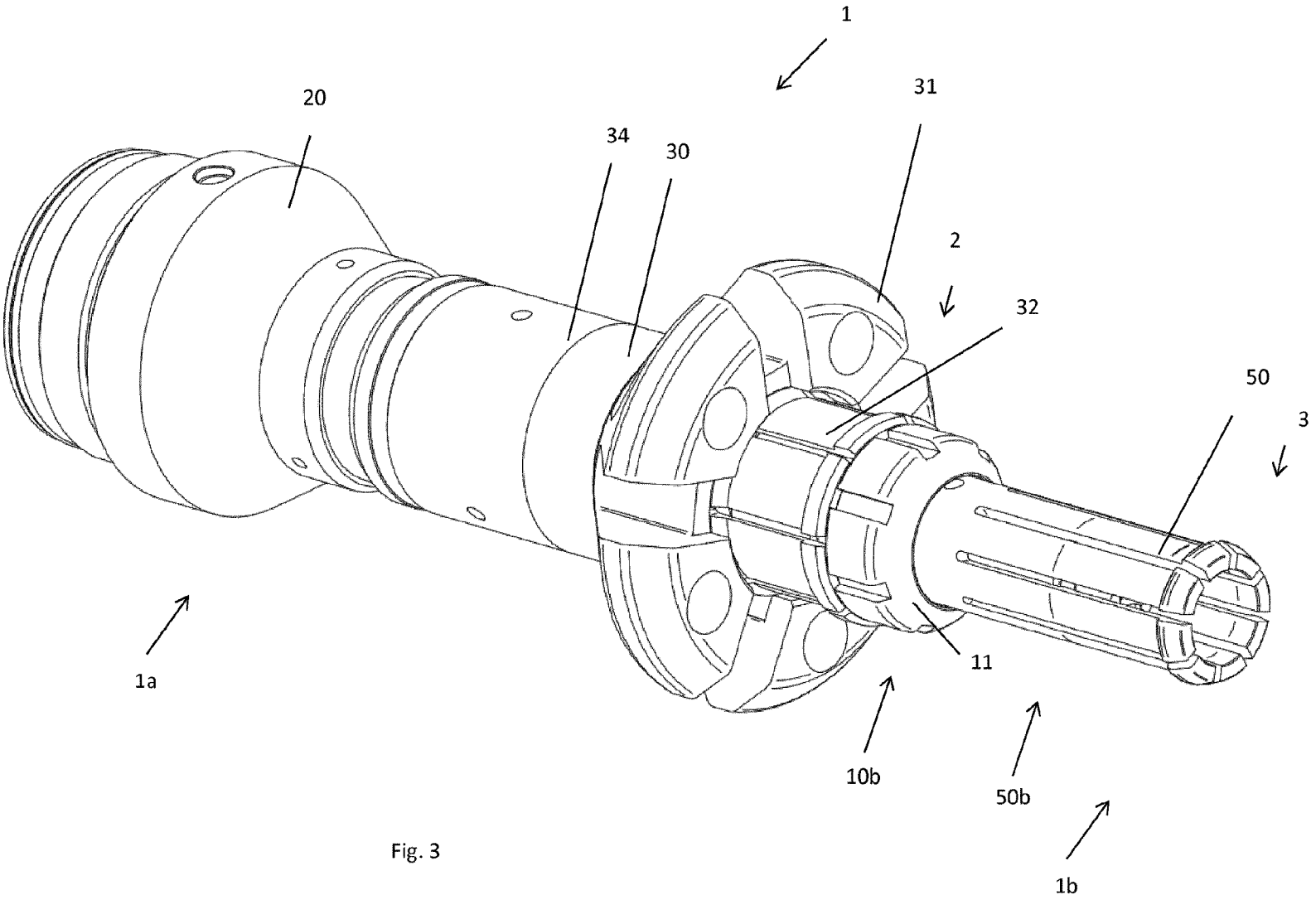
FIG. 3 illustrates a perspective view of the setting and retrieval device according to the invention.
Figure 4:
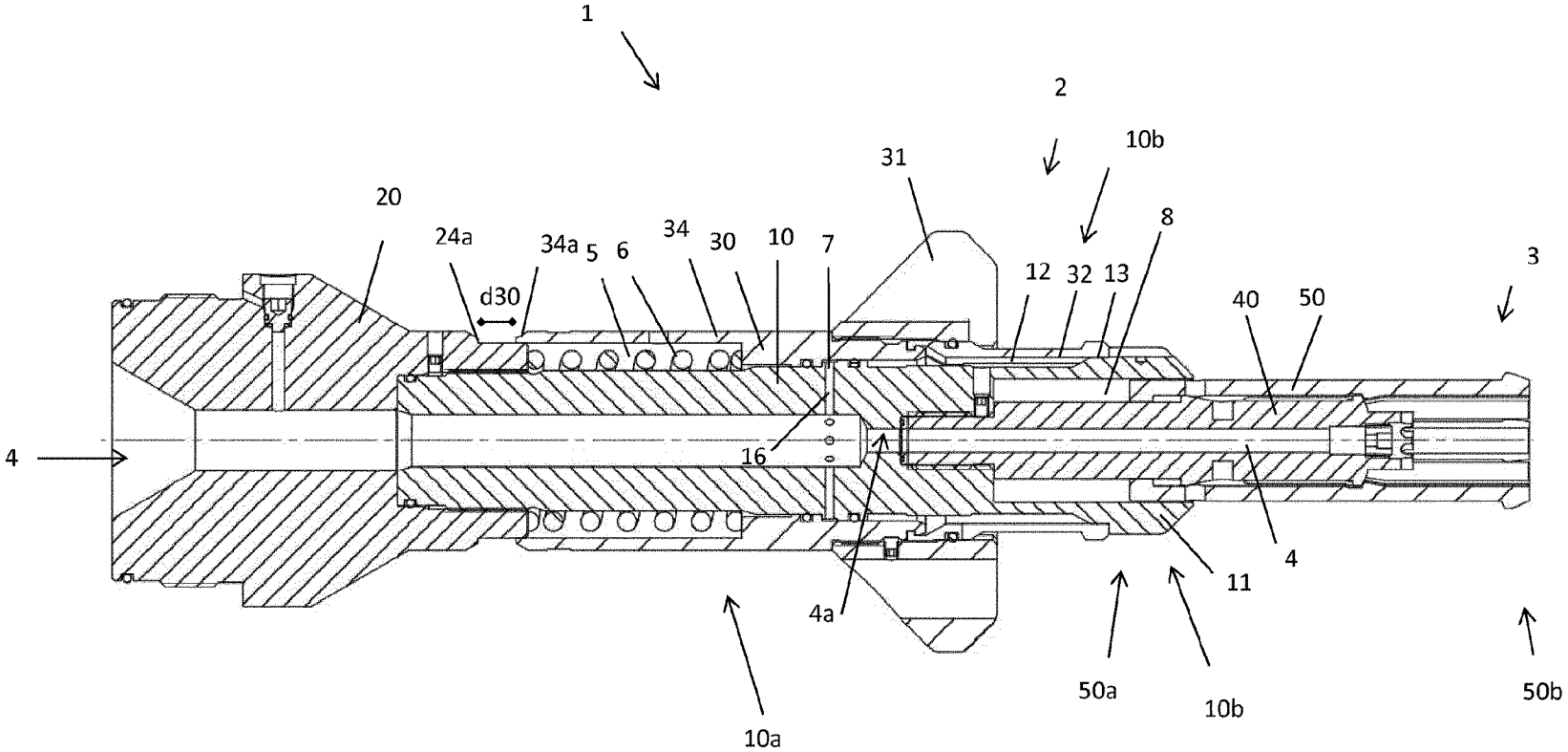
FIG. 4 illustrates a cross section of the device.

It is now referred to FIGS. 3 and 4. Here, a first embodiment of a device 1 for setting a crown plug A in a well head and for retrieving the crown plug A from the well head is illustrated.

The device 1 comprises an upper plug connection device generally indicated by arrow 2 for connection to the upper connection interface CI1 of the crown plug A and a lower plug connection device generally indicated by arrow 3 for connection to the lower connection interface CI2 of the crown plug A.

The device 1 comprises a mandrel device 10, a top sub device 20, a housing device 30, a locking element 40 and a snap sleeve device 50.

The top sub device 20 is connected to the topside via a string (not shown). The string may for example be a drilling string. Hence, a drilling crew of the drilling rig may operate the device 1, i.e. the drilling crew may perform the setting and/or retrieval operation of the crown plug.

The mandrel device 10 is substantially cylindrical and has an upper end 10*a* and a lower end 10*b*. The upper end 10*a* of the mandrel device 10 is connected to the top sub device 20, as indicated in FIG. 4. Most of the mandrel device 10 is hidden within the outer housing 30 in FIG. 3. In FIG. 3, only a lower end section 11 is shown protruding downwardly out from the outer housing 30.

The lower end 10*b* of the mandrel device 10 comprises an outer supporting surface 13 and a recess 12 provided circumferentially around the outside of the lower end section 11 of the mandrel device 10.

The outer housing device 30 is provided radially outside the mandrel device 10. The outer housing 30 comprises a centralizer body 31 for centralizing the device 1. The outer housing 30 also comprises a sleeve section 34. A spring compartment 5 is provided radially between the upper part of the mandrel device 10 and the sleeve section 34, where a spring device 6 is provided in the spring compartment 5. Axial displacement between the outer housing 30 and the mandrel device 10 is allowed. In the initial state, the spring device 6 is pushing the housing device downwardly to its lowermost position. The sub device 20 may be pushed axially upwardly (to the left in the drawings), thereby compressing the spring device 6. This will be described further in detail below.

The outer housing 30 further comprises first finger connectors 32 provided radially outside the lower end section 11 of the housing device. The first finger connectors 32 are provided for connection to the upper connection interface CI1 of the crown plug A.

The upper plug connection device 2 may be configured between a unlocked state and a locked state depending on the axial position of the outer housing device 30 in relation to the mandrel device 10. In the unlocked state, the first finger connectors 32 are being retracted into the recess 12 of the lower end 10*b* of the mandrel device 10. In the locked state, the first finger connectors 32 are being supported by the outer supporting surface 13 of the lower end 10*b* of the mandrel device.

A fluid bore 4 is provided inside the device 1. The fluid bore 4 comprises a fluid restriction section 4*a*. On the upper side of the fluid restriction section 4*a*, the mandrel section 10 comprises a fluid channel 16 leading out to a piston chamber 7 provided between the mandrel device 10 and the outer housing 30. By increasing the fluid flow into the bore 4, the pressure above the fluid restriction section 4*a* will increase, thereby causing a force in the piston chamber 7 counteracting the piston force caused by the spring device 6. Hence, by increasing the fluid pressure in the piston chamber 7, the outer housing 30 will be axially displaced upwards in relation to the mandrel device 10. The length d30 of the maximum upward displacement of the outer housing device 30 may be limited by a stopping device. In the present embodiment, the stopping device comprises an upper end 34*a* of the sleeve section 34 which will meet a stop 24*a* of the upper sub device 20 when the outer housing device 30 has been displaced the distance d indicated in FIG. 4. In this upper position, the first finger connectors 32 are being retracted into the recess 12 (unlocked state).

By decreasing the fluid pressure again, the outer housing device 30 will be displaced axially downwards in relation to the mandrel device again, due to the force provided by the spring device 6. During the downward movement, the first finger connectors 32 will be guided up and radially outwards onto the outer supporting surface 13 (locked state).

The spring device 6 is providing a first force F1 pushing the outer housing device 30 axially downwards in relation to the mandrel device 10, thereby bringing the upper plug connection device 2 towards its locked state. The upper plug connection device 2 is configured to be brought to its unlocked state by pushing the outer housing device 30 axially upwards in relation to the mandrel device 10 as described above.

The upper crown connection interface CI1 is considered known from the GS tool mentioned in the introduction above, and will therefore not be described further in detail.

Figure 5:
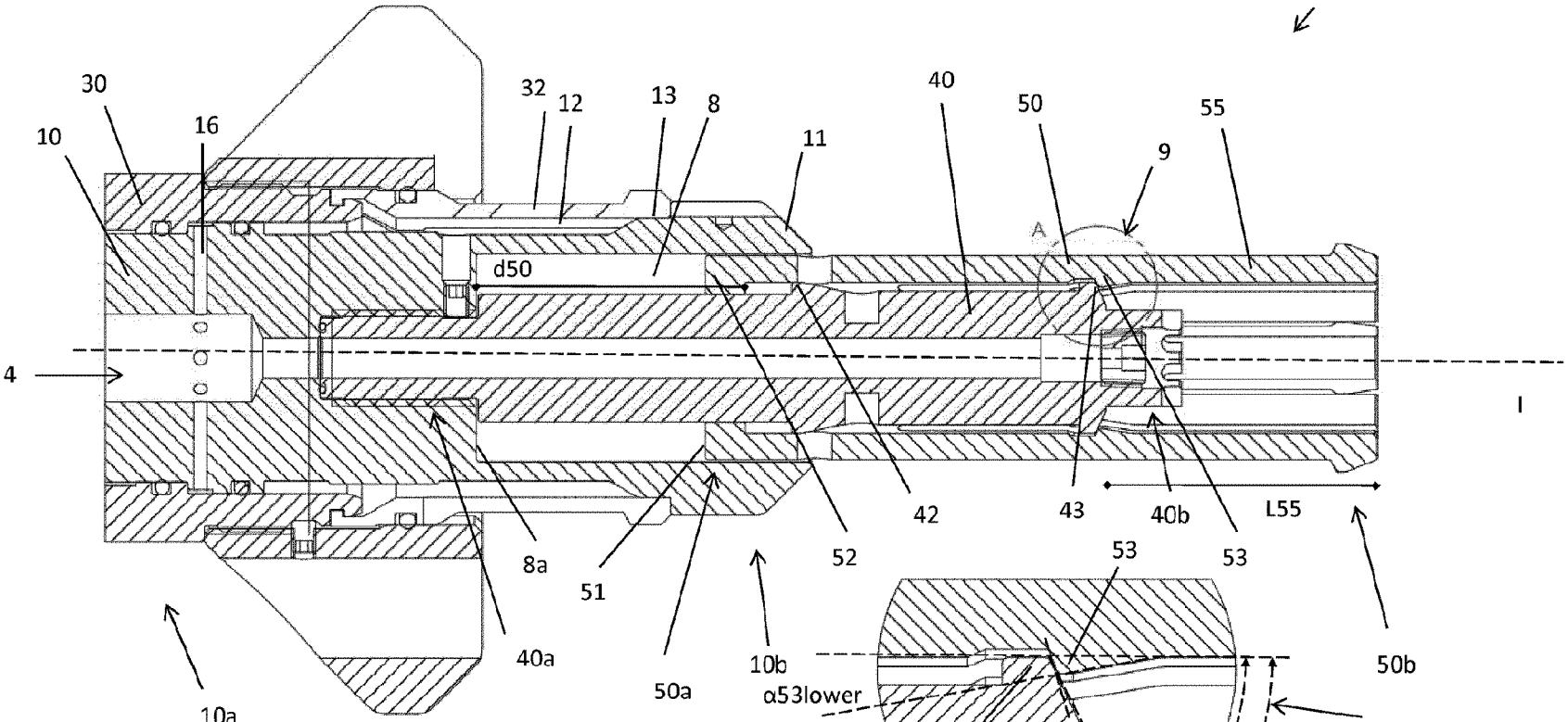
FIG. 5 illustrates a cross section of the lowermost part of the device.

The locking element 40 is also substantially cylindrical and has an upper end 40*a* fixed to the mandrel device 10 and a lower end 40*b*. The bore 4 through the sub device 20 and the mandrel device 10 is continued through the locking element 40, as shown in FIGS. 4 and 5. The center of the through bore 4 coincides with the center axis I of the device 1. In the present embodiment, the upper end 40*a* of the locking element 40 is fixed to the mandrel device 10 by means of a threaded connection. Consequently, the locking element 40 may be seen as an extension of the mandrel device 10.

As seen in FIG. 5, an annular compartment 8 is provided radially outside of at least parts of the locking element 40 and radially inside the lower end section 11 of the mandrel device 10.

The snap sleeve device 50 comprises an upper end 50*a* and a lower end 50*b*. The upper end 50*a* is provided in the annular compartment 8. Hence, in FIG. 3 it can be seen that the lower end of 50*b* is protruding out from the annular compartment 8.

The snap sleeve device 50 is axially displaceable in relation to the mandrel device 10.

It is now referred to FIG. 5. Here it is shown that the locking device 40 comprises an outwardly protruding stop 42. The stop 42 is in the present embodiment axially aligned with the lowermost end of the lower end section 11. The snap sleeve device 50 comprises a stop surface 51 in its upper end 50*a*. The snap sleeve device 50 also comprises an inwardly protruding stop 52 close to its upper end 50*a*.

The snap sleeve device 50 further comprises second finger connectors 55 provided in the lower end 50*b* of the snap sleeve device 50. The second finger connectors 55 are forming the lower plug connection device 3.

The snap sleeve device 50 is in its lower end position when the inwardly protruding stop 52 is in contact with the outwardly protruding stop of the locking device 40. This is referred to as the unlocked position for the lower plug connection device 3. In this unlocked position, the second finger connectors 55 may be pressed radially inwards by applying a radial force onto them. Hence, in this position, it is possible to connect to the second connection interface CL2 of the crown plug A by axially pushing the finger connectors 55 into the second connection interface CL2. Likewise, it is possible to disconnect from the second interface CL2 by pulling the finger connectors 55 out from the second connection interface CL2 (assuming that the second connection interface CL2 is held stationary).

The snap sleeve device 50 is in its upper end position when the stop surface 51 is in contact with the bottom surface 8*a* of the compartment 8. This is referred to as the locked position for the lower plug connection device 3. In this position, it is not possible for the finger connectors 55 to be pushed radially inwards and connect to or disconnect from the second connection interface CL2 of the crown plug A, since the locking device 40 is preventing such inward movement of the finger connectors 55.

As indicated in FIG. 5, the snap sleeve device 50 may move axially a distance D50. In the present embodiment, the distance D50 is substantially equal to the length L55 of the second finger connectors 55.

Figure 6:
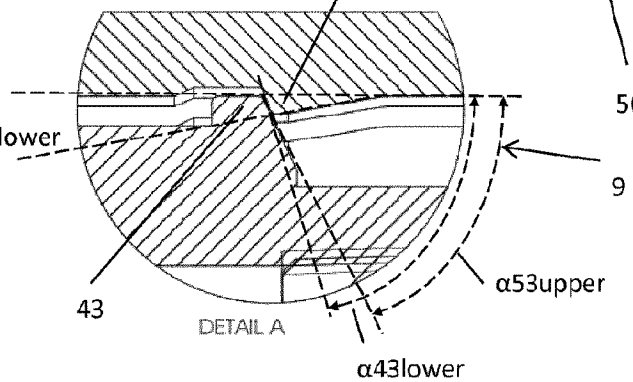
FIG. 6 is an enlarged view of detail A in FIG. 5.

The device 1 further comprises a force threshold mechanism 9, of which an enlarged view is shown in FIG. 6. The force threshold mechanism 9 is formed by parts of the locking element 40 and the snap sleeve device 50 engaging with each other, as will be described in the following.

The force threshold mechanism 9 is formed by an inwardly protruding collar 53 protruding inwardly from the snap sleeve device 50 and an outwardly protruding collar 43 protruding outwardly from the locking device 40. In the unlocked state, the collar 53 is located below the collar 43, while in the locked state, the collar 53 is provided above the collar 43.

The force threshold mechanism 9 is configured to provide that the force Fup required to move the inwardly protruding collar 53 from the lower side of the outwardly protruding collar 43 to the upper side of the outwardly protruding collar 43 is greater than the force Fdown required to move the inwardly protruding collar 53 from the upper side of the outwardly protruding collar 43 to the lower side of the outwardly protruding collar 43. For example, the force Fup may be twice as large as the force Fdown.

In one embodiment, the force Fup may be at least two times the force Fdown. However, the force Fup may be ten times the force Fdown.

In the present embodiment, this is achieved by designing the collar 53 with an angle α53lower for the lowermost part of the collar 53 in relation to the longitudinal axis being less than an angle α53upper for the uppermost part of the collar in relation to the longitudinal axis.

Preferably, the angle α53lower is between 5-30°, even more preferable 8-20°. In the present embodiment, the angle α53lower is about 15°.

Preferably, the angle α53upper is between 45-85°, even more preferable 60-80°. In the present embodiment, the angle α53upper is about 65°.

The collar 43 is designed with an angle α43lower for the lowermost part of the collar 43 in relation to the longitudinal axis being approximately equal to the angle α53upper.

Preferably, the angle α43lower is between 45-85°, even more preferable 60-80°. In the present embodiment, the angle α53upper is about 70°.

It should be noted that the above angles will be dependent on a several factors which must be taken into consideration during the design of the device, for example the type of material with respect to its roughness and hardness (determining the friction between the collars 43, 53) and the geometry of the device, such as the material thickness of the finger connectors 55, the location of the collars with respect to the recesses between the finger connectors 55 etc.

In the present embodiment, the inwardly protruding collar 53 is provided axially close to the bottom of the finger connectors 55, i.e. to the end of the slot separating the respective finger connectors 55 from each other. However, the location of the collar 53 will depend on the flexibility of the finger connectors 55.

In the following, the operation of the device 1 will be described with reference to FIGS. 7-10.

Figure 7:
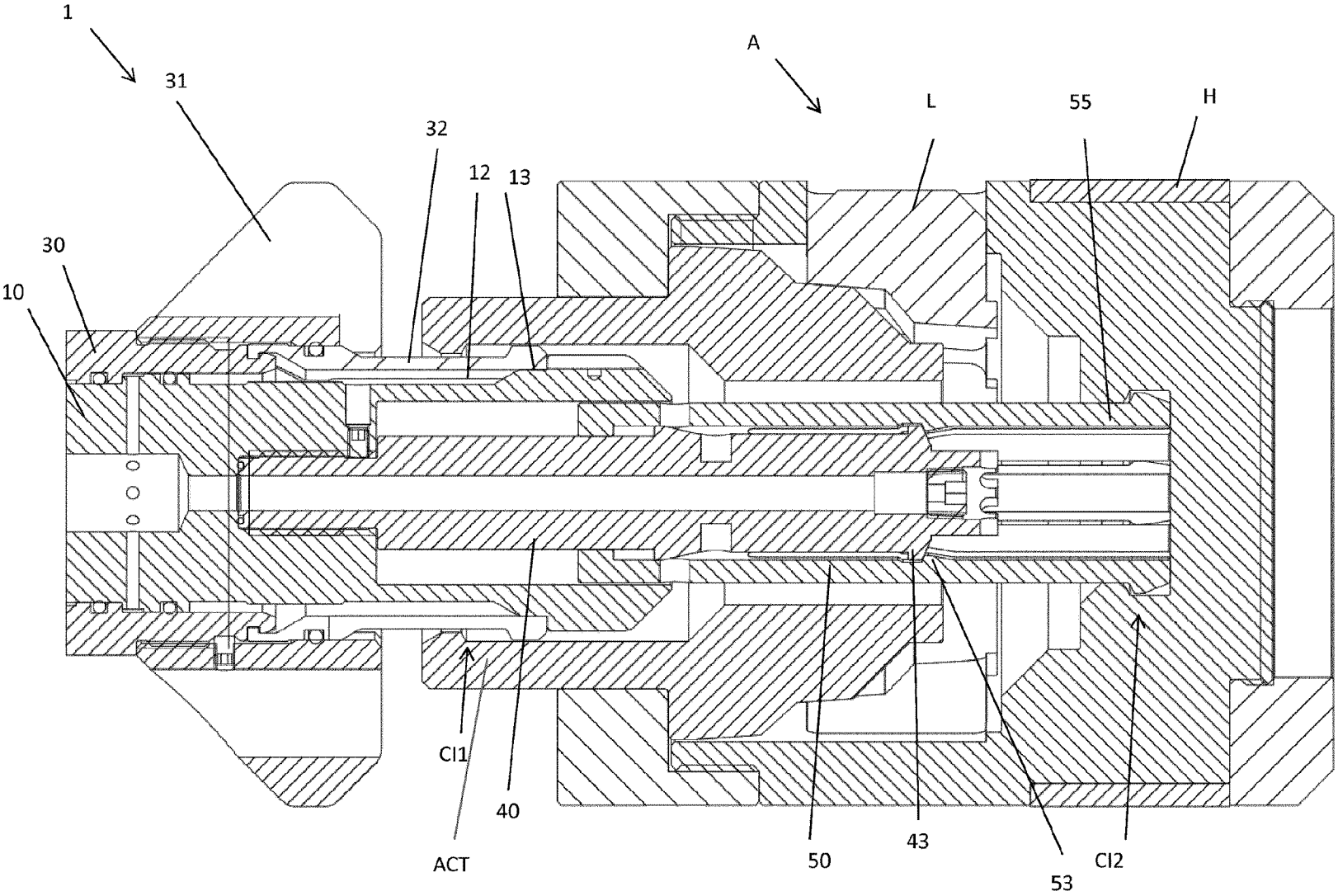
FIG. 7 illustrates the setting and retrieval device connected to the crown plug in their first state.

In FIG. 7, the device 1 is connected to the crown plug A, typically this is performed topside before the crown plug is to be set in the well head. As shown, the second connector fingers 55 (forming the lower plug connection device 3 of the device 1) are connected to the lower connection interface CI2. The snap sleeve device 50 is in the unlocked state, with the inwardly protruding collar 53 located axially below the outwardly protruding collar 43.

The first finger connectors 32 (forming a part of the upper plug connection device 2 of the device 1) are connected to the upper connection interface CI1. As shown, the upper plug connection device 2 is in its locked state, since the first finger connectors 32 are supported by the supporting surface 13.

It is shown that in FIG. 7, the actuator ACT is in the upper position, i.e. the locking device L is radially retracted. Hence, the crown plug is in its run state.

The crown plug A together with the device 1 is now run into the well.

Figure 8:
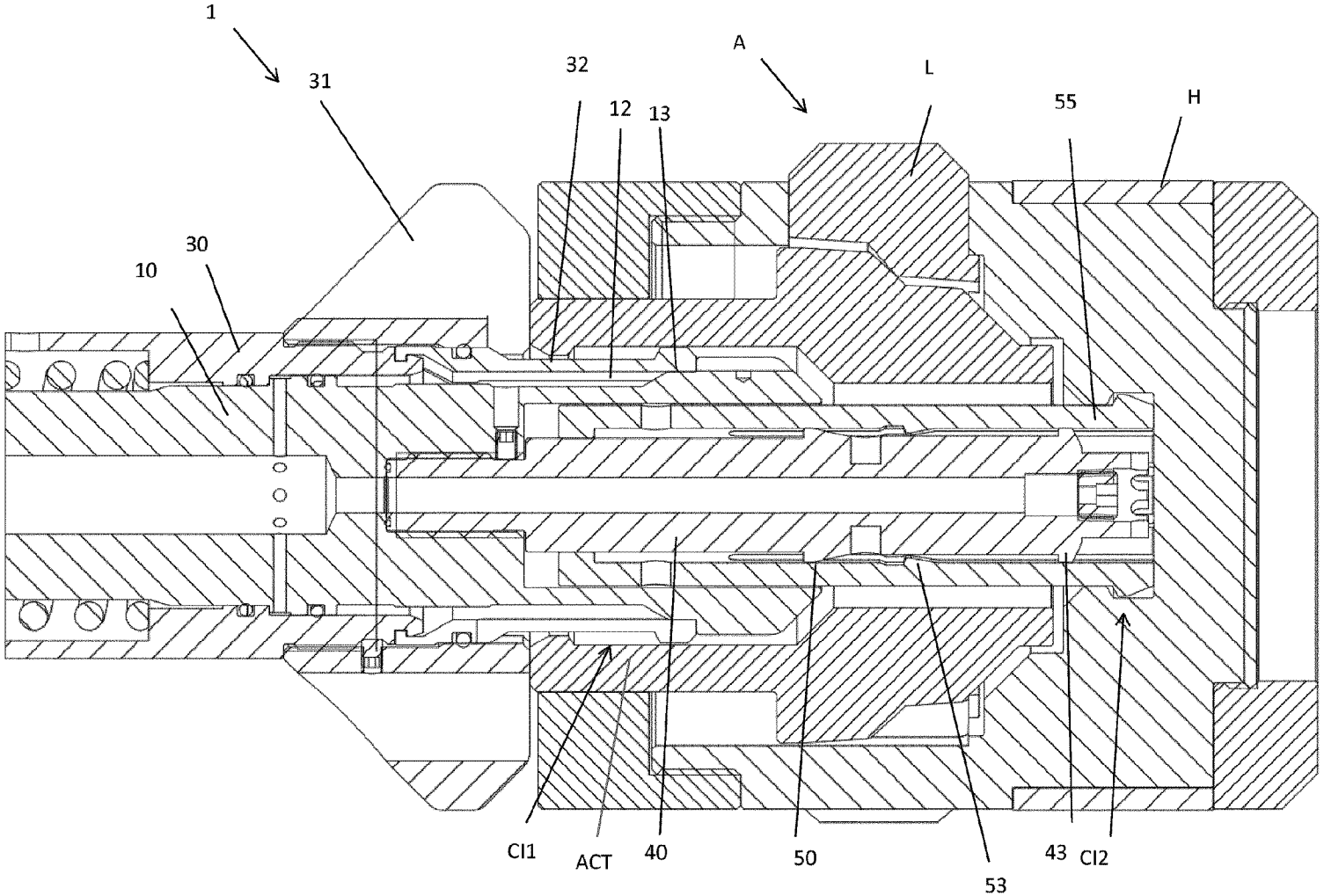

In FIG. 8, the crown plug A has been run into the well head. A downwardly directed force has been applied to the device 1, thereby causing the body 31 to push the actuator ACT of the crown plug A down, bringing the locking device L radially outwards to its locked state. In order to do so, the force applied to the device 1 must be larger than the force Fup, to provide that the inwardly protruding collar 53 of the force threshold mechanism 9 is moved from the lower side of the outwardly protruding collar 43 to the upper side of the outwardly protruding collar 43. The force Fup is sufficiently large to be registered topside, providing a confirmation that the crown plug has been set.

Figure 9:
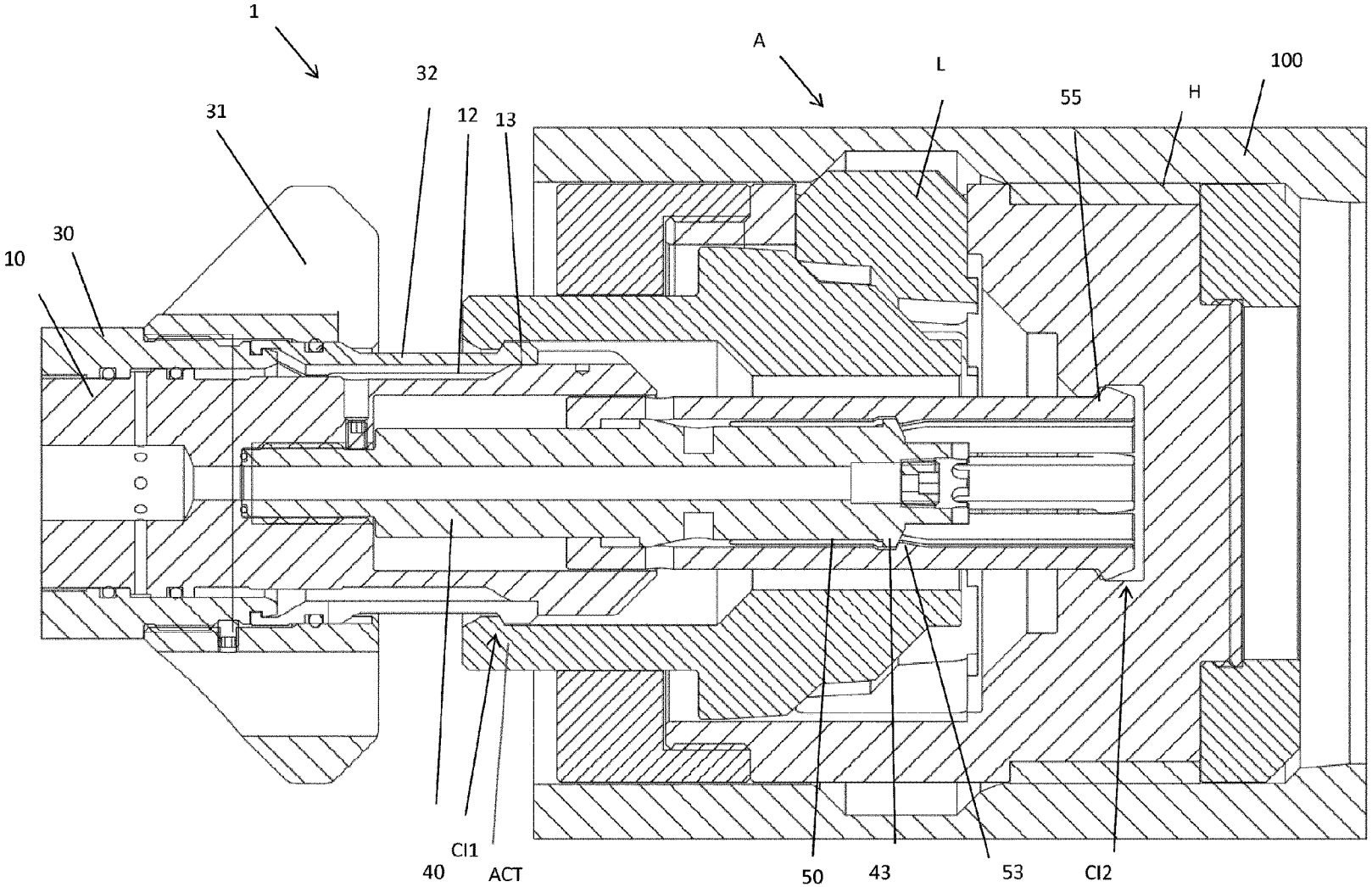
FIG. 9 illustrates the setting and retrieval device connected to the crown plug in their second state.

In FIG. 9, an upwardly directed force is applied to the device 1. As the upper connection fingers 32 are supported by the supporting surface 13, the actuator ACT is pulled upwards, bringing the locking device from the set state to the run state. At the same time, the locking device 40 is pulled upwardly in relation to the snap sleeve device 50. Here, the force Fdown required to pull the outwardly protruding collar 43 from a position below the collar 53 to a position above the collar 53 (i.e. same movement as moving collar 53 from position above collar 43 to position below collar 43) is substantially lower than the force Fup.

Consequently, the lower plug connection device 3 is brought to the unlocked state. The lower plug connection device 3 is now reconfigured to the initial state, and the device 1 together with the crown plug A can be retrieved to the topside, or the device 1 can set the plug A again (by performing the operation described above with reference to FIG. 8.

Figure 10:
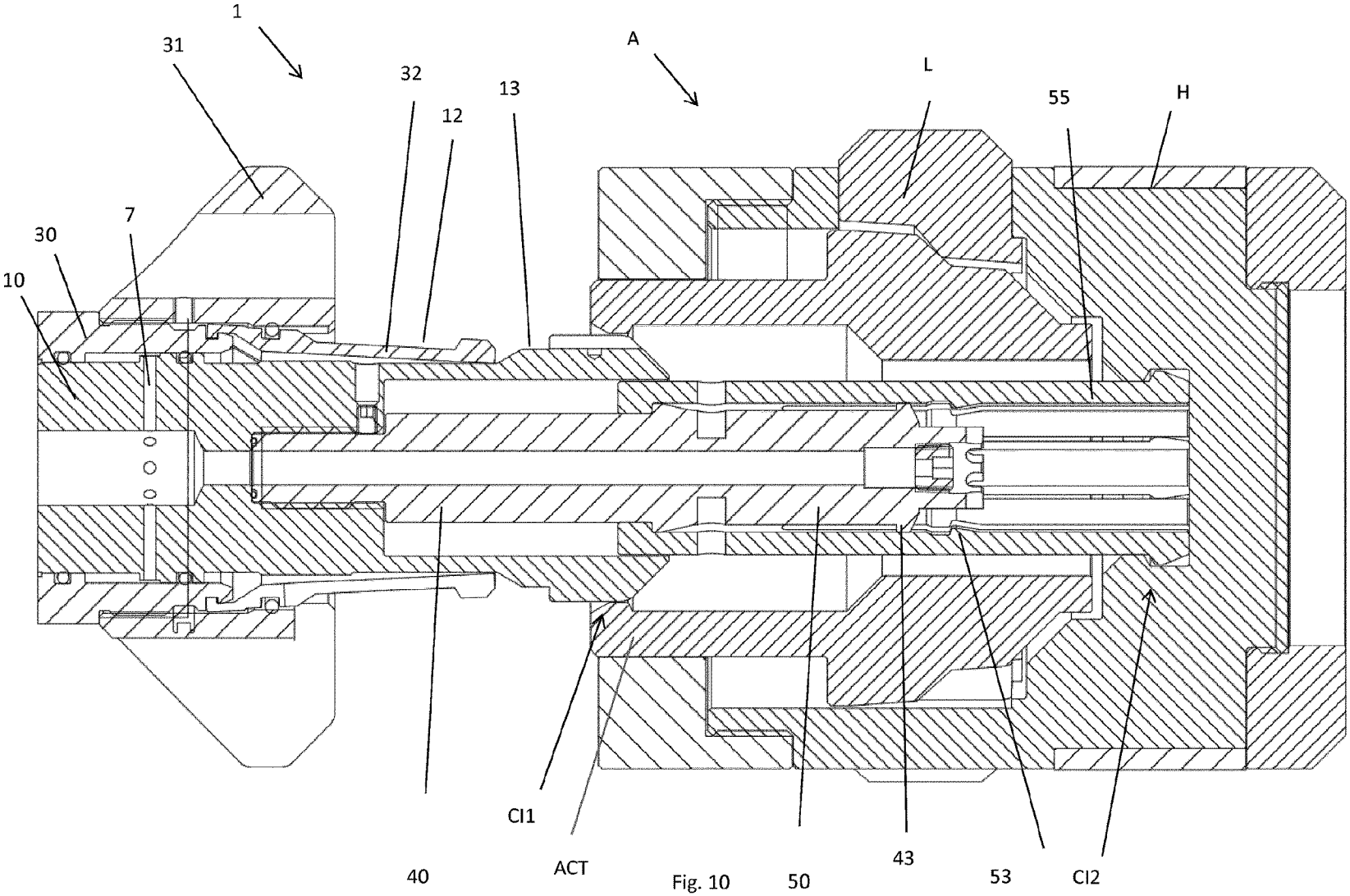
FIG. 10 illustrates the setting and retrieval device connected to the crown plug in their fourth state.

It is now referred to FIG. 10. Here, the setting operation in FIG. 8 was performed first. Then, the upper plug connection device 2 is brought to the unlocked state by pumping fluid into the bore 4 and channel 7, thereby moving the outer housing device 30 upwards and bringing the first finger connectors 32 into the recess 12. The device 1 is now pulled upwards, pulling the finger connectors 32 up and out from the upper connection interface CI1. At the same time, the lower plug connection device 3 is brought to the unlocked state, by pulling the locking device 40 upwards in relation to the snap sleeve device 50, as the second finger connectors 55 are still connected to the lower connection interface CL2. When in the unlocked state, the lower plug connection device 3 (the second finger connectors 55) can be pulled out from the second connection interface CL2. Now, the device 1 is disconnected from the crown plug A and the device 1 can be pulled out from the well.

The invention claimed is:

1. A device for setting a crown plug in a well head and for retrieving the crown plug from the well head; where the crown plug comprises an upper connection interface and a lower connection interface; where the device comprises:

- a mandrel device having an upper end connected to a top sub device and a lower end;
- an outer housing device provided radially outside the mandrel device;
- a snap sleeve device downwardly protruding from the lower end of the mandrel device;
- an upper plug connection device for connection to the upper connection interface of the crown plug; wherein the upper plug connection device comprises first finger connectors; wherein the upper plug connection device may be configured between a locked state and an unlocked state by relative axial displacement between the mandrel device and the outer housing device;
- a lower plug connection device for connection to the lower connection interface of the crown plug, wherein the lower plug connection device comprises second finger connectors provided in a lower end of the snap sleeve device;
- wherein the device further comprises a locking element fixed to the lower end of the mandrel device;
- wherein an annular compartment is provided radially outside of at least parts of the locking element and radially inside a lower end section of the mandrel device;
- wherein an upper end of the snap sleeve device is provided axially displaceable in the annular compartment;
- wherein the lower plug connection device may be configured between a locked state and an unlocked state by axial displacement of the snap sleeve device in relation to the locking element, wherein connection to and disconnection from the lower connection interface of the crown plug is prevented in the locked state.

2. The device according to claim 1, wherein the locking element is forming an axial extension of the mandrel device.

3. The device according to claim 2, wherein the snap sleeve device is provided radially outside of the locking element, and where radial movement of the second finger connectors is prevented by the locking element in the locked state.

4. The device according to claim 2, wherein the snap sleeve device is in its upper end position when an upper stop surface is in contact with a bottom surface of the compartment and where the snap sleeve device is in its lower end position when an inwardly protruding stop of the snap sleeve device is in contact with an outwardly protruding stop of the locking device.

5. The device according to claim 2, wherein the device further comprises a force threshold mechanism providing that a first force required to displace the snap sleeve device downwardly is greater than a second force required to displace the snap sleeve device upwardly.

6. The device according to claim 2, wherein a longitudinal fluid bore is provided through the top sub device, the mandrel device, the releasable locking element and the snap sleeve device, thereby allowing fluid flow from the upper end of the device to the lower end of the device.

7. The device according to claim 1, wherein the snap sleeve device is provided radially outside of the locking element, and where radial movement of the second finger connectors is prevented by the locking element in the locked state.

8. The device according to claim 7, wherein the snap sleeve device is in its upper end position when an upper stop surface is in contact with a bottom surface of the compartment and where the snap sleeve device is in its lower end position when an inwardly protruding stop of the snap sleeve device is in contact with an outwardly protruding stop of the locking device.

9. The device according to claim 7, wherein the device further comprises a force threshold mechanism providing that a first force required to displace the snap sleeve device downwardly is greater than a second force required to displace the snap sleeve device upwardly.

10. The device according to claim 7, wherein a longitudinal fluid bore is provided through the top sub device, the mandrel device, the releasable locking element and the snap sleeve device, thereby allowing fluid flow from the upper end of the device to the lower end of the device.

11. The device according to claim 1, wherein the snap sleeve device is in its upper end position when an upper stop surface is in contact with a bottom surface of the compartment and where the snap sleeve device is in its lower end position when an inwardly protruding stop of the snap sleeve device is in contact with an outwardly protruding stop of the locking device.

12. The device according to claim 11 wherein the device further comprises a force threshold mechanism providing that a first force required to displace the snap sleeve device downwardly is greater than a second force required to displace the snap sleeve device upwardly.

13. The device according to claim 1, wherein the device further comprises a force threshold mechanism providing that a first force required to displace the snap sleeve device downwardly is greater than a second force required to displace the snap sleeve device upwardly.

14. The device according to claim 13, wherein the force threshold mechanism comprises an inwardly protruding collar of the snap sleeve device and an outwardly protruding collar of the locking element configured to be engaged with each other, where the first force is required to displace the inwardly protruding collar from the lower side of the outwardly protruding collar to the upper side of the outwardly protruding collar and where the second force is required to move the inwardly protruding collar from the upper side of the outwardly protruding collar to the lower side of the outwardly protruding collar.

15. The device according to claim 14, wherein the inwardly protruding collar has an angle lower for the lowermost part of the collar in relation to the longitudinal axis being less than an angle upper for the uppermost part of the collar in relation to the longitudinal axis.

16. The device according to claim 15, wherein the angle lower is between 5-30° and wherein the angle upper is between 45-85°.

17. The device according to claim 16, wherein the outwardly protruding collar is designed with an angle lower for the lowermost part of the collar in relation to the longitudinal axis being approximately equal to the angle upper.

18. The device according to claim 15, wherein the outwardly protruding collar is designed with an angle lower for the lowermost part of the collar in relation to the longitudinal axis being approximately equal to the angle upper.

19. The device according to claim 15, wherein the angle lower is between 8-20° and wherein the angle upper is between 60-80°.

20. The device according to claim 1, wherein a longitudinal fluid bore is provided through the top sub device, the mandrel device, the releasable locking element and the snap sleeve device, thereby allowing fluid flow from the upper end of the device to the lower end of the device.

* * * * *